US009635988B2

(12) United States Patent
Chen et al.

(10) Patent No.: US 9,635,988 B2
(45) Date of Patent: May 2, 2017

(54) TOILET SEAT COVER WITH A FULL-DIRECTIONAL NIGHT LAMP

(71) Applicant: HOTI (XIAMEN) PLUMBING INC., Xiamen (CN)

(72) Inventors: Guobin Chen, Kiamen (CN); Feng Guo, Xiamen (CN)

(73) Assignee: HOTI (XIAMEN) PLUMBING INC., Xiamen, Fujian (CN)

( * ) Notice: Subject to any disclaimer, the term of this patent is extended or adjusted under 35 U.S.C. 154(b) by 13 days.

(21) Appl. No.: 14/639,120

(22) Filed: Mar. 5, 2015

(65) Prior Publication Data

US 2016/0088984 A1 Mar. 31, 2016

(30) Foreign Application Priority Data

Sep. 27, 2014 (CN) ..... 2014 1 0501654

(51) Int. Cl.

| | |
|---|---|
| ***A47K 13/24*** | (2006.01) |
| *F21V 33/00* | (2006.01) |
| *F21S 9/02* | (2006.01) |
| *F21Y 115/10* | (2016.01) |

(52) U.S. Cl.

CPC ..... *A47K 13/24* (2013.01); *F21S 9/02* (2013.01); *F21V 33/004* (2013.01); *F21Y 2115/10* (2016.08)

(58) Field of Classification Search

CPC .... A47K 13/24; A47K 13/26; F21V 33/0004; F21Y 2101/02

USPC ..... 4/234–240, 661

See application file for complete search history.

(56) References Cited

U.S. PATENT DOCUMENTS

| | | | | |
|---|---|---|---|---|
| 5,003,648 A * | 4/1991 | Anderson | ..... | A47K 13/30 4/314 |
| 5,123,130 A * | 6/1992 | Sanders | ..... | A47K 17/00 4/234 |
| 5,437,066 A * | 8/1995 | Mills | ..... | A47K 13/24 362/191 |
| 5,896,600 A * | 4/1999 | Mills | ..... | A47K 13/26 4/240 |
| 6,168,288 B1 * | 1/2001 | St. Claire | ..... | F21L 4/027 362/184 |

(Continued)

FOREIGN PATENT DOCUMENTS

| | | | |
|---|---|---|---|
| CN | 201175307 * 11/2009 | | |
| CN | WO 2010022615 A1 * 3/2010 | ..... | A47K 13/12 |

(Continued)

*Primary Examiner* — Erin Deery

(74) *Attorney, Agent, or Firm* — Leong C. Lei

(57) ABSTRACT

A toilet seat cover with a full-directional night lamp includes an upper lid, a seat and two supports. A cylindrical night lamp is locked on the upper lid or locked between two seat shaft sleeves at two sides of the seat. The night lamp comprises at least one electric body and at least one light-pervious tube. The electric body has at least one end thereof defined as a light source end. The light source end of the electric body is axially sleeved on and fixed to the light-pervious tube. The whole night lamp can be detachably mounted on the upper lid or locked between the two seat shaft sleeves at two sides of the seat, thereby attaining a full 360 degree emission of light and allowing the lighting emission to be free of the operation state of the toilet seat cover.

9 Claims, 11 Drawing Sheets

(56) References Cited

U.S. PATENT DOCUMENTS

| | | | | |
|---|---|---|---|---|
| 7,036,158 | B2 * | 5/2006 | Bradford | F21V 33/004 4/240 |
| 2014/0250578 | A1 * | 9/2014 | Murphy | A47K 13/24 4/420 |
| 2015/0351594 | A1 * | 12/2015 | Veros | A47K 13/24 4/237 |

FOREIGN PATENT DOCUMENTS

| | | | |
|---|---|---|---|
| CN | 201870555 | * | 6/2011 |
| CN | 203122270 | * | 8/2013 |
| CN | 103989437 | * | 8/2014 |

* cited by examiner

TOILET SEAT COVER WITH A FULL-DIRECTIONAL NIGHT LAMP

(A) TECHNICAL FIELD OF THE INVENTION

This invention relates to a luminous toilet seat cover and relates particularly to a toilet seat cover with a full-directional night lamp which attains a 360 degree lighting effect, facilitates a quick replacement and maintenance of lighting sources and batteries, and keeps the light free of the working state of the toilet seat cover.

(B) DESCRIPTION OF THE PRIOR ART

A general luminous toilet seat cover mainly includes a night lamp source mounted on a side surface or a front edge of an upper lid or a seat thereof. The night lamp source mounted on the upper lid or mounted on the seat needs to cooperate with a driving power circuit. Generally, the installation method and location of the night lamp source and the driving power circuit affect the appearance and lighting range of the toilet seat cover directly.

A China patent published by CN201870555U discloses a luminous toilet seat cover which mounts a battery box 3 on a bottom surface of an upper lid 1. Two shaft sleeves 1.1 are disposed at two sides of the upper lid 1. An LED light assembly 4 is disposed in a hole 1.3 defined on a top surface of the upper lid and sealed by a transparent cover 5. Two batteries 3.2 in the battery box 3 provide the LED light assembly 4 with electricity. Such structure has some problems. First, the LED light assembly 4 can only emit light rays with a certain emitting angle and a fixed illumination range through the transparent cover 5 (light window) by plane transmitting. Second, the installation location and the installation method of the LED light assembly 4 are detrimental to the appearance of the toilet seat cover and are not easy to replace and maintain. Third, when the upper lid is opened up, the battery box 3 formed in a plate shape or a square shape mounted on the bottom surface of the upper lid seems to be unpleasant to the eyes. Fourth, it is not convenient to replace the batteries in the plate-shaped battery box 3 embedded in the hole of the upper lid and blocked by the transparent cover 5.

A China patent published by CN103961017A discloses a connecting assembly for a toilet seat cover and a seat. This prior art comprises a shaft sleeve 70 connected to the toilet seat cover and two shanks 80 fixed to a toilet seat body. A fastening mechanism, including a fixing shaft 10, a lock 20, a spring 30, a controlling rotary shaft 10 and a cap 50, is mounted in each end of the shaft sleeve 70. This fastening mechanism is adapted to control the locking or unlocking action of the shanks 80 which penetrates the shaft sleeve and is inserted into the fixing shaft 10. Two damping devices 60 are respectively disposed at two sides of the shaft sleeve 70. Each damping device 60 is disposed at an outside of the fixing shaft 10 and projects from the shaft sleeve 70 for connecting to the toilet seat cover. A lighting device 90, including a plate 92 pervious to light and a lighting substrate 94, is received in the shaft sleeve 70. The shaft sleeve 70 disposes a window 72 which is pervious to light and adapted to allow the plate 92 of the device 90 to transmit light therefrom. Such connecting assembly for the toilet seat cover has some problems. First, because the shaft sleeve 70 of the connecting assembly is connected to the toilet seat cover, the lighting device 90 and batteries are mounted in the middle of the shaft sleeve 70. To replace the broken lighting device 90 or batteries run out of electricity, such structure has to detach the toilet seat cover from the shanks 80 firstly, open a cover in the middle of the shaft sleeve 70, and take the lighting device 90 (or batteries) from the shaft sleeve. Alternatively, such structure requires the user to spend more time bending the body and opening the cover of the shaft sleeve 70 on the toilet seat cover fixed to the toilet seat body in order to take the lighting device 90 (or batteries) out for following maintenance and replacement. Thus, it is not convenient to maintain and replace the lighting device 90 or batteries. Second, only one window 72 pervious to light is disposed in the middle of the shaft sleeve 70 toward a front side of the toilet seat cover, so the lighting range and lighting effect of light rays of the lighting device 90 are limited, and the light rays transmitted from the window 72 are unable to satisfy the need for the maximum illumination range of the night lamp. Further, while sitting on the seat, the user shades the light rays transmitted from the single-directional window 72. This renders the lighting device unable to function as a night lamp.

SUMMARY OF THE INVENTION

It is an object of this invention to provide a toilet seat cover with a full-directional night lamp which attains a full 360 degree lighting effect as the rear of the toilet seat cover is rotated and lifted, satisfies the need for a light-indicating function as the toilet seat cover is closed and for a maximum illumination range as the toilet seat cover is lifted and opened, charges or replaces battery more quickly and convenient, and attains a more quick and convenient maintenance or replacement of the lighting device.

Accordingly, the toilet seat cover with a full-directional night lamp of this invention comprises an upper lid, a seat and two supports. Two lid shaft sleeves at two sides of a rear of the upper lid are respectively hinged to two seat shaft sleeves at two sides of a rear of the seat by using respective hinges. Each of the two supports has a pin capable of radially inserting in or extracting from each of the two hinges for a connection fit. This invention is characterized in that a cylindrical night lamp is locked with the upper lid or locked in a space defined between the two seat shaft sleeves of the seat. The night lamp includes at least one electric body and at least one light-pervious tube. The electric body has two ends, and at least one end of the electric body is defined as a light source end. The light source end of the electric body is axially sleeved on and connected to the light-pervious tube. Two ends of the night lamp are respectively and elastically locked with the upper lid or locked with the two seat shaft sleeves at two sides of the seat by using respective locking units.

Preferably, the night lamp includes one electric body and two light-pervious tubes. The two ends of the electric body are defined as respective light source ends. One end of each light-pervious tube is fixed to each end of the electric body. The other end of each light-pervious tube is sealed by the locking unit.

Preferably, the night lamp includes two electric bodies and one light-pervious tube. One end of each electric body is defined as the light source end. The light source ends of the two electric bodies are respectively fixed to two ends of the light-pervious tube. The other end of each electric body is sealed by the locking unit.

Preferably, a battery house is radially disposed in the middle of the electric body. At least one battery is radially mounted in the battery house. A lid is locked with an opening of the battery house. A circuit board is disposed at each end of the electric body and electrically connected to the battery.

An LED light source is mounted on each circuit board to emit light toward the light-pervious tube. The circuit board and the LED light source are constructed as the light source end. The LED light source axially disposed on the electric body of the night lamp can provide the interior of the light-pervious tube with light rays for illumination, and the light rays can be transmitted from a radial wall of the light-pervious tube to present weaker light rays. The light rays transmitted from the light-pervious tube can provide the 360 degree illumination. Concurrently, the transmitted light rays from the light-pervious tube can illuminate a ceramic body of a closestool and a front wall of a tank in a rear thereof. When a toilet seat cover of the ceramic body of the closestool is closed, the light rays transmitted from the light-pervious tube are thrown on the wall of the tank and reflected. The reflected light rays of the tank wall are adapted to illuminate. Simultaneously, a light ring is formed in a gap between the toilet seat cover and the ceramic body. When a user sits on the seat with the upper lid lifted up and opened, the reflected light rays thrown on the tank wall by the light-pervious tube can satisfy the need for the night illumination of the toilet although the light rays thrown forward by the light-pervious tube are shaded by the user.

Preferably, a battery house is axially disposed on the electric body. At least one battery is axially mounted in the battery house. A circuit board is fixed to one end of the electric body and electrically connected to the battery. An LED light source is mounted on the circuit board to emit light toward the light-pervious tube. The circuit board and the LED light source are constructed as the light source end. The other end of the electric body is fixed to the locking unit. The locking unit blocks the battery house. A spring electrode is disposed on a back surface of the locking unit. The locking unit fixed at the end of the electric body blocks the battery house to be connected in series with the battery.

Preferably, a locking hole is axially formed on the upper lid or on each seat shaft sleeve of the seat. An indentation is formed on an inner periphery of each locking hole. A spring is disposed on the locking unit. A locking ring, projecting from the spring and aligning with the locking hole, is embedded into the locking hole. An axial end surface of the locking ring is a slope capable of receiving a squeezing action of an end surface of the seat shaft sleeve and causing a deformation of the spring. A locking piece is disposed at an end of the locking ring and positioned in the indentation. When two ends of the night lamp are forced into the upper lid or into the space between the two seat shaft sleeves, the respective springs help the night lamp lock with the upper lid or fix between the two seat shaft sleeves quickly, and the respective locking pieces and indentations cooperate to prevent the rotation of the whole night lamp. Extracting the night lamp radially with a larger force can disconnect the springs from the upper lid or from the two seat shaft sleeves of the seat. Thus, it is very quick and convenient to maintain and replace the night lamp, and it is convenient and easy to mount and remove the batteries. The night lamp can also be detached for other uses according to the need.

Preferably, a sealing cushion is sleeved into a back of the locking unit. The sealing cushion is adapted to prevent water from entering the light-pervious tube or the electric body through the locking unit and prevent the water from impinging on the light transmission effect of the light-pervious tube or the property of the circuit board of the electric tube.

Preferably, the lid shaft sleeves at two sides of the rear of the upper lid are located at an outside of the seat shaft seats at two sides of the rear of the seat. A long slot is radially formed on the seat shaft seat, and the pin is inserted into the hinge by penetrating the long slot.

Preferably, the lid shaft sleeves at two sides of the rear of the upper lid are located at an inside of the seat shaft seats at two sides of the rear of the seat. A long slot is radially formed on the lid shaft seat, and the pin is inserted into the hinge by penetrating the long slot.

By adopting the aforementioned structure, the night lamp capable of attaining a 360 degree light emission can be quickly mounted and detached in the space of the middle of the rear of the toilet seat cover. After the night lamp is detached, the maintenance and the replacement of the lighting part of the night lamp and the replacement of the batteries are convenient and quick. The 360 degree light emission of the night lamp throws light rays on a front wall of a tank and a ceramic body of a closestool concurrently, so the reflected light rays can satisfy the need for the night illumination. When the upper lid is lifted up and leaned against a front edge of the tank, the light rays emitted by the night lamp throw on an included area between the ceramic body of the closestool and the upper lid. When the upper lid and the seat are put down and close the closestool, the light rays emitted upward by the light-pervious tube are shaded by the upper lid and the seat, and a light ring is formed between a gap between seat and the ceramic body of the closestool. This light ring can indicate the location of the closestool at night, and the reflected light rays thrown backward on the front wall of the tank can function as an illumination for the toilet. This invention changes the night illumination light according to the opening and closing state of the toilet seat cover in order to prevent the too strong light from stimulating eyes and awaking the brain and prevent the awoken brain from interfering with the sleep of the user.

The Advantages of this Invention are:

1. Because the whole night lamp can be detachably mounted on the upper lid or locked between the two shaft sleeves of the seat, the night lamp can be fully detached for the following maintenance and the replacement of the battery.
2. The light-pervious tube of the night lamp connected between the shaft sleeves in the rear of the toilet seat cover can provide a full 360 degree light emission. The tank wall and the ceramic body of the closestool can reflect the thrown light rays to form a backlight illumination. When the toilet seat cover is put down for closing, the light-pervious tube throws the light on the tank wall to provide an illumination with weaker light. A light ring is concurrently formed between the seat and the ceramic body to indicate where the closestool is. The illumination and the light-indication effect are not affected by the operation state of the toilet seat cover.
3. The detachment of the night lamp from the rear of the toilet seat cover does not impinge on the appearance of the toilet seat cover, and the installation of the night lamp on the toilet seat cover does not affect the hinging and detaching structure of the toilet seat cover, either.

DETAILED DESCRIPTION OF THE PREFERRED EMBODIMENTS

The advantages of this invention are described in conjunction with the following embodiment and accompanying drawings.

The First Preferred Embodiment

Two Ends of the Night Lamp are Locked Between Two Seat Shaft Sleeves

Figure 1:
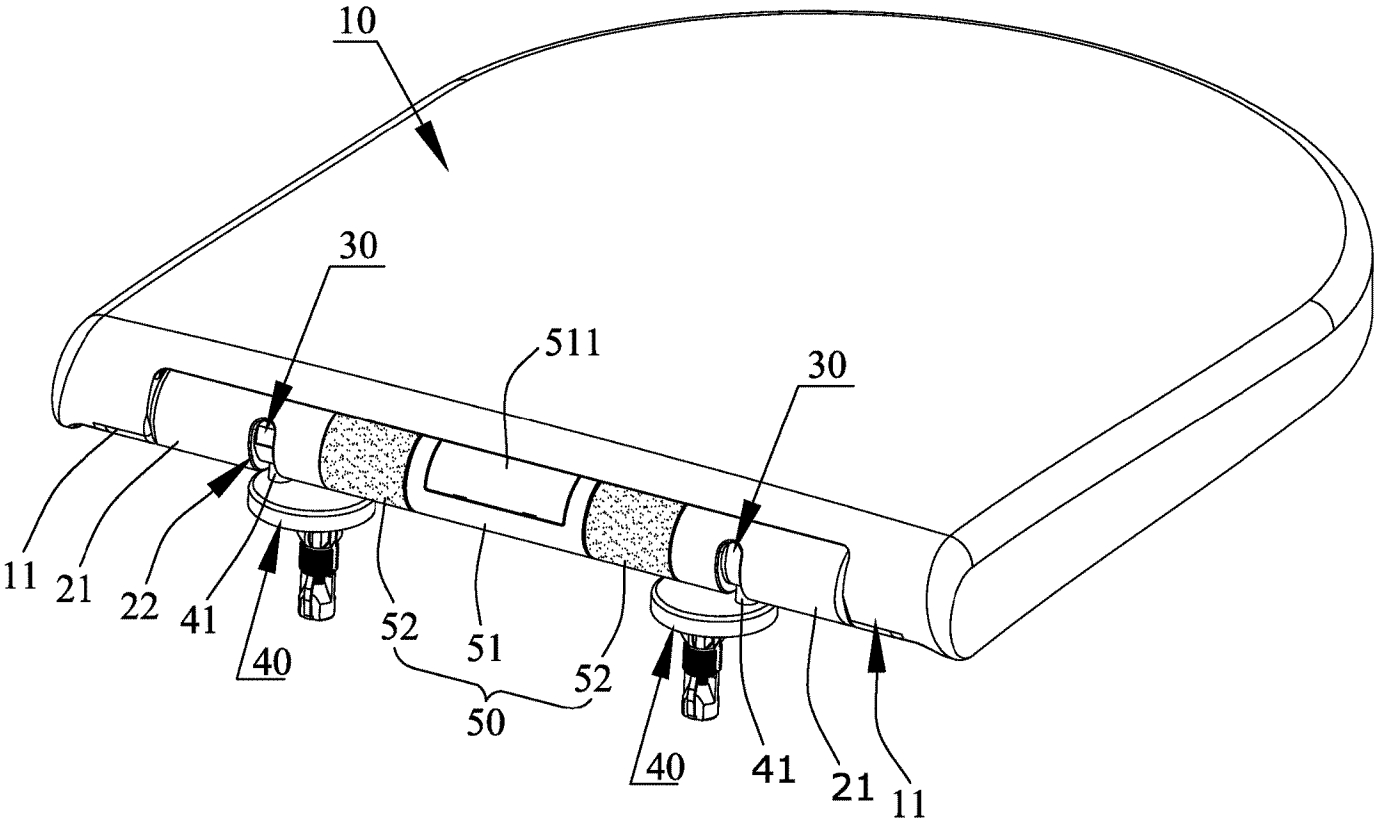
FIG. 1 is a perspective view showing a first preferred embodiment of this invention of which an upper lid and a seat are closed.
Figure 2:
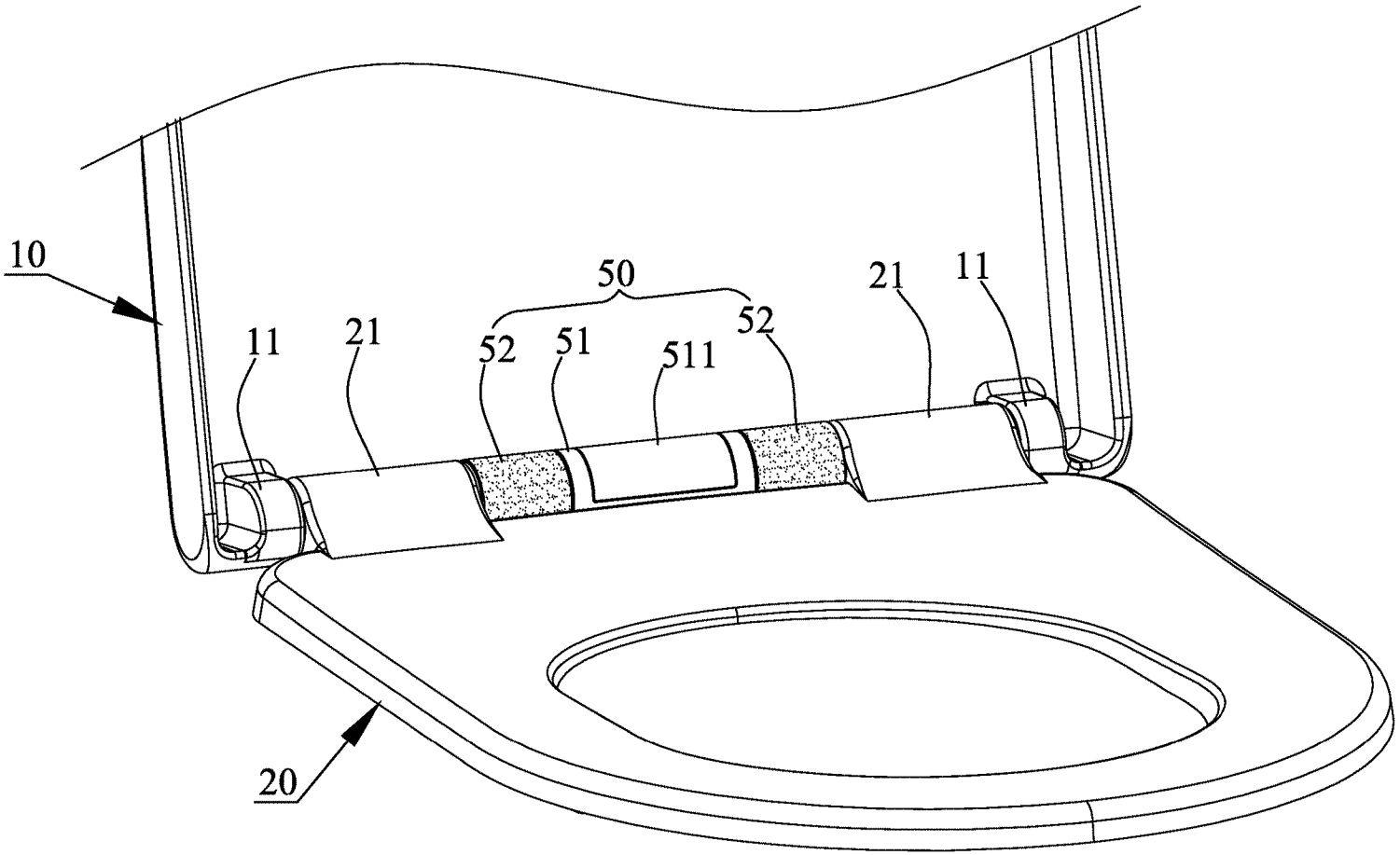
FIG. 2 is a perspective view showing the first preferred embodiment of this invention of which the upper lid is lifted and opened and the seat is not pulled up.
Figure 3:
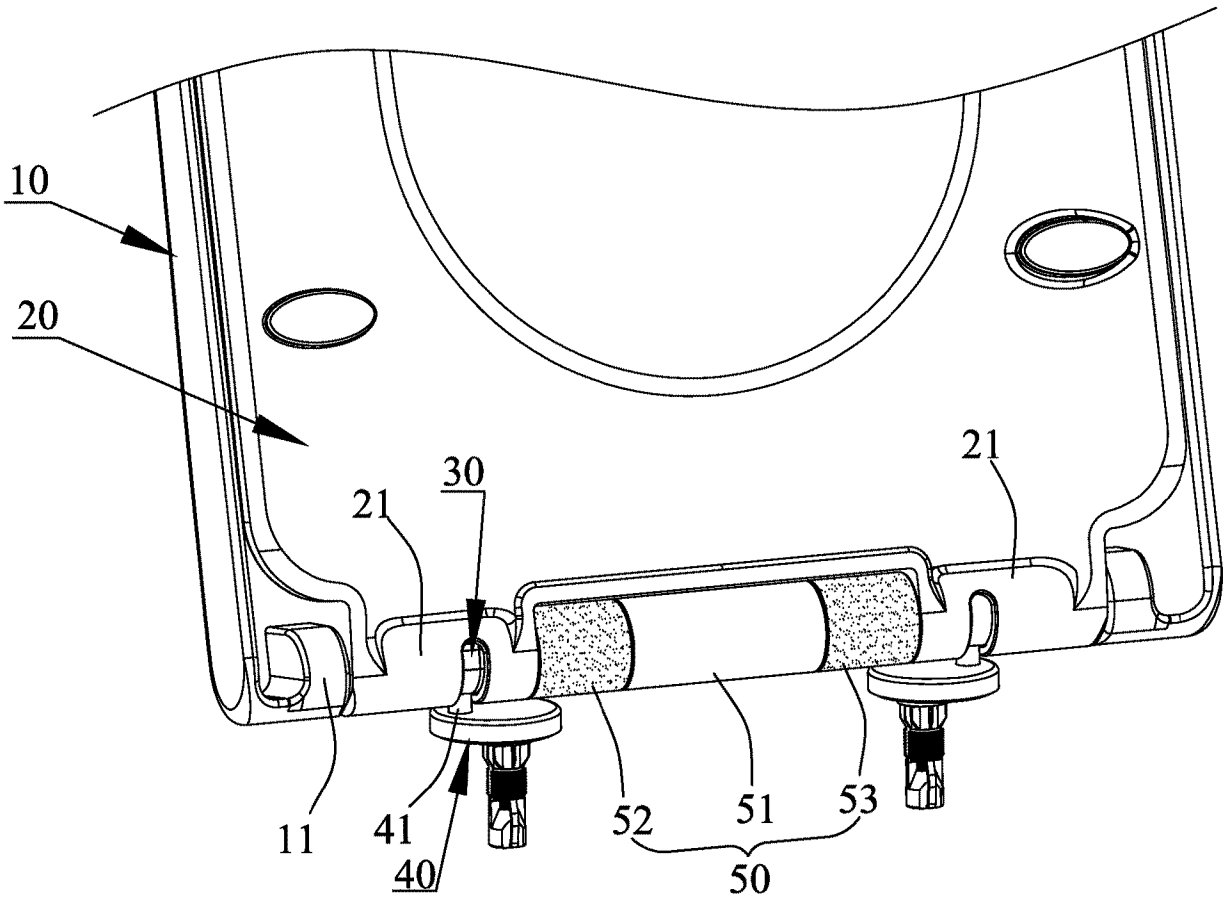
FIG. 3 is a perspective view showing the first preferred embodiment of this invention of which the seat is pulled up to be in contact with the opened upper lid.

Referring to FIGS. 1-3, a toilet seat cover with a full-directional night lamp of this invention comprises an upper lid 10, a seat 20 and two supports 40. Two lid shaft sleeves 11 at two sides of a rear of the upper lid 10 are respectively hinged to two seat shaft sleeves 21 at two sides of a rear of the seat 20 by using respective hinges 30. The two lid shaft sleeves 11 are located at an outside of the two seat shaft sleeves 21, respectively. Each of the two supports 40 has a pin 41 which penetrates each long slot 22 formed on the seat shaft sleeve 21 and provides a radial insertion and extraction fit with each of the two hinges 30. A cylindrical night lamp 50 is locked in a space defined between the two seat shaft sleeves 21 at the two sides of the rear of the seat 20.

Figure 6:
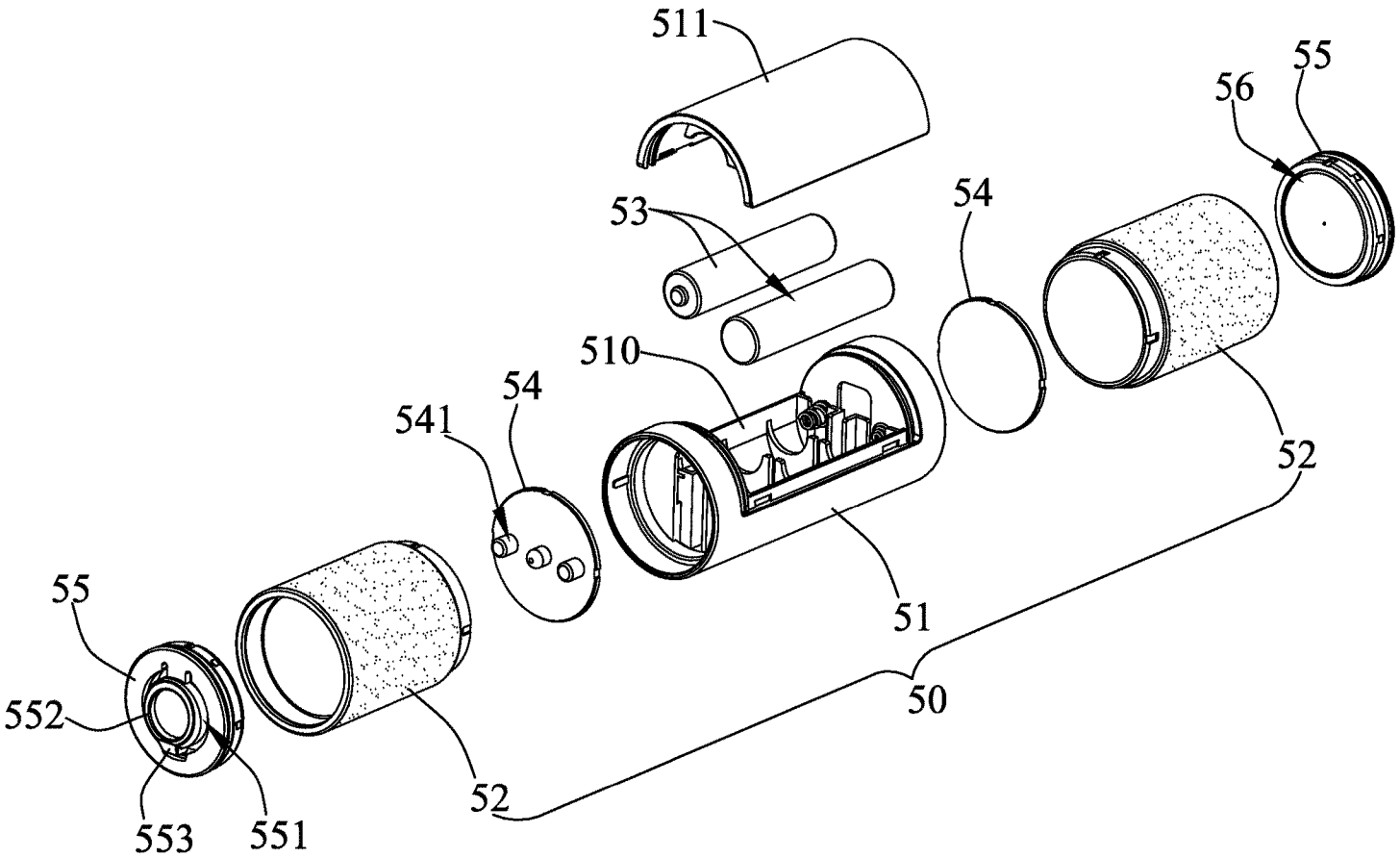
FIG. 6 is an exploded view of the first preferred embodiment of this invention showing the claimed night lamp.
Figure 7:
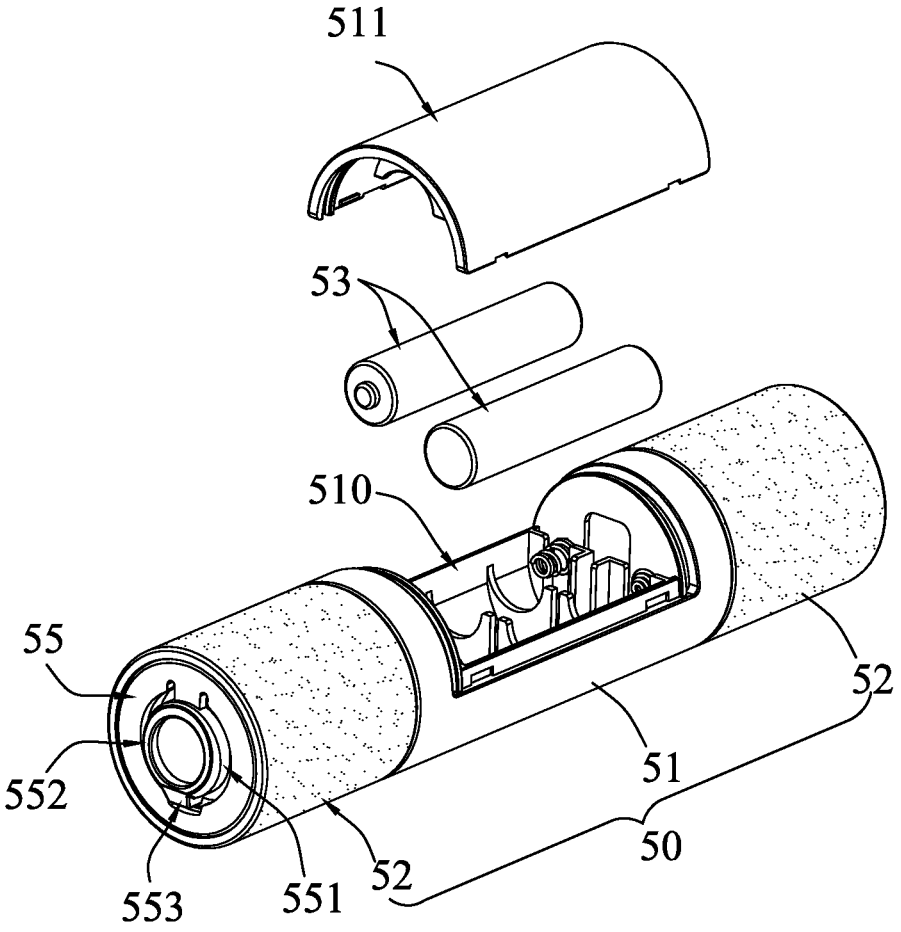
FIG. 7 is an exploded view of the first preferred embodiment of this invention showing at least one battery is mounted in the night lamp.
Figure 8:
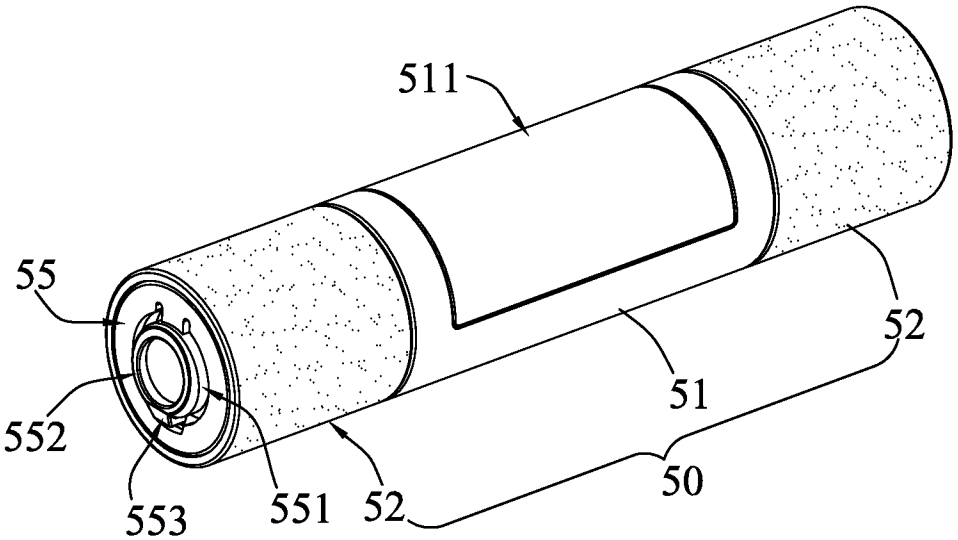
FIG. 8 is a perspective view showing the whole night lamp of the first preferred embodiment of this invention.

Referring to FIGS. 6-8, the night lamp 50 includes one electric body 51 and two light-pervious tubes 52. A circuit board 54 is disposed at each end of the electric body 51 and electrically connected to at least one battery 53 or batteries 53. An LED light source 541 is mounted on each circuit board 54 to emit light toward each light-pervious tube 52. The circuit board 54 and the LED light source 541 are constructed as a light source end of the electric body 51. In other words, the two ends of the electric body are respective light source ends. The two ends of the electric body 51 are respectively fixed to one end of each light-pervious tube 52. The other end of each light-pervious tube 52 is sealed by a locking unit 55. A sealing cushion 56 is sleeved into a back of the locking unit 55. A battery house 510 is radially disposed in the middle of the electric body 51. Batteries 53 are radially mounted in the battery house 510. A lid 511 is locked with an opening of the battery house 510 to fix the batteries 53 in position. Thus, the assembly of the night lamp 50 is completed.

Figure 4:
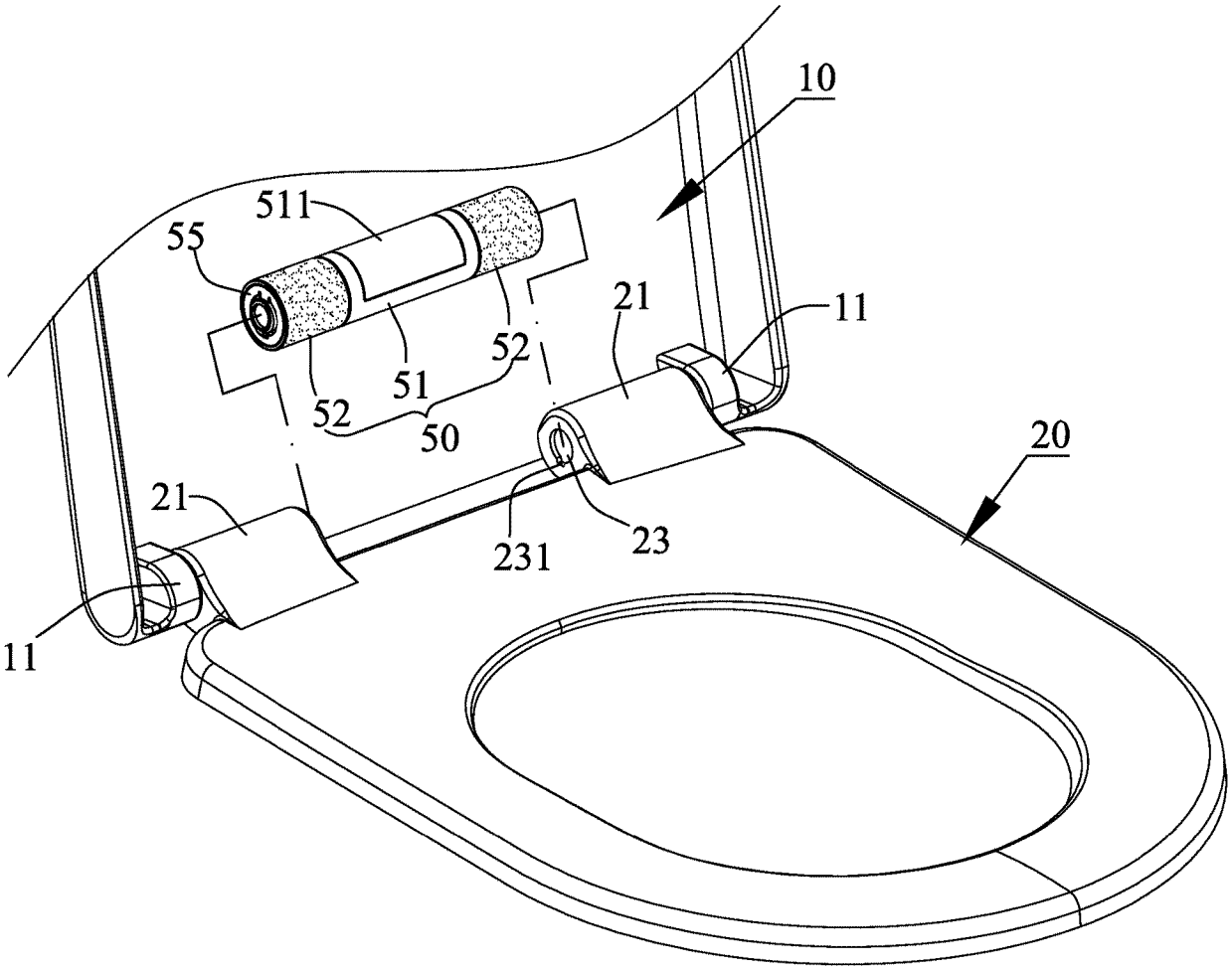
FIG. 4 is a perspective view of the first preferred embodiment of this invention showing the claimed night lamp can be mounted between or be disconnected from the claimed seat shaft sleeves.

Referring to FIGS. 4-8, two locking units 55 are respectively disposed at the outside of the two light-pervious tubes 52 of the night lamp 50. In other words, the two locking units 55 are disposed at two ends of the night lamp 50. Referring to FIG. 4 and FIG. 8, a locking hole 23 is axially formed on each seat shaft sleeve 21 of the seat 20. An indentation 231 is formed on an inner periphery of each locking hole 23. A spring 551 is disposed on the locking unit 55. A locking ring 552, projecting from the spring 551 and aligning with the locking hole 23, is embedded into the locking hole 23. An axial end surface of the locking ring 552 is a slope capable of receiving a squeezing action of an end surface of the seat shaft sleeve 21 and causing a deformation of the spring 551. A locking piece 553 is disposed at an end of the locking ring 552 and positioned in the indentation 231.

Referring to FIG. 4, the two locking units 55 at two ends of the night lamp 50 are respectively aimed at the locking holes 23 of the seat shaft sleeves 21 at two sides of the seat 20. Then, the night lamp 50 is pressed down to enter the space between the two seat shaft sleeves 21. Therefore, the end surface of each seat shaft sleeve 21 squeezes to impinge on the slope of the locking ring 552 and cause the spring 551 to bend. As clearly shown in FIG. 5, when each locking ring 52 is in alignment with each locking hole 23, the spring 551 returns to the original place so that the locking ring 552 can be lodged in the locking hole 23. Thus, the night lamp 50 is fixed between the two seat shaft sleeves 21. Each locking piece 553 is also lodged in each indentation 231 to render the night lamp 50 unable to rotate relative to the two seat shaft sleeves 21. The night lamp 50, as shown in FIG. 2, is quickly mounted and snapped into the space between the two seat shaft sleeves 21 in the rear of the seat 20.

The operating principle and operations of this invention are described as follows.

Figure 5:
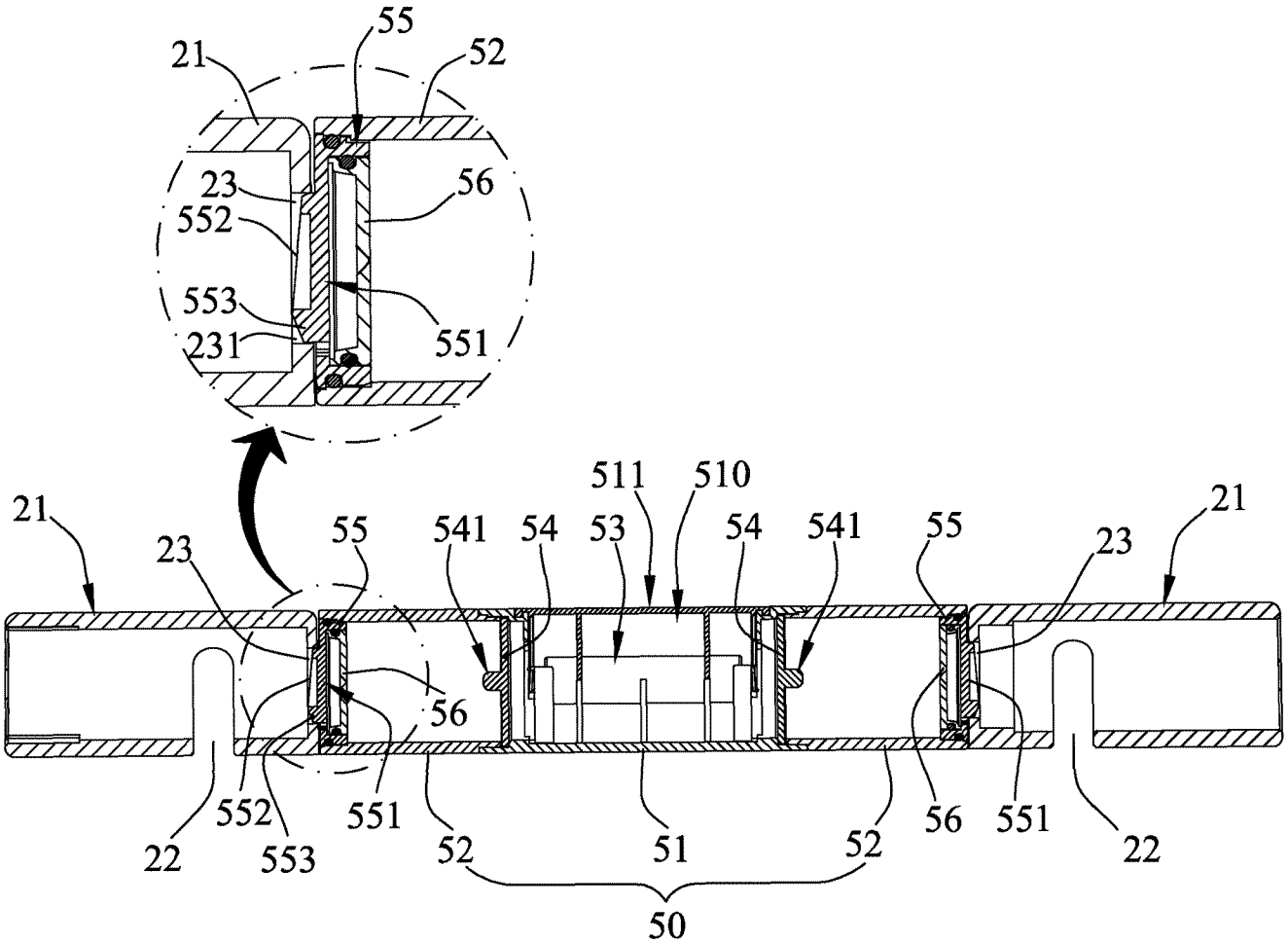
FIG. 5 is a cross-sectional view of the first preferred embodiment of this invention showing the claimed night lamp in elastic connection with the claimed seat shaft sleeves.

Referring to FIG. 5 and FIG. 8, the batteries 53 in the electric body 51 provides the circuit board 54 with electricity to turn on the LED light source 541. The LED light sources 541 at two ends of the electric body 51 illuminate the interior of each of the light-pervious tubes 52, and the two light-pervious tubes 52 of the night lamp 50 throw light with weaker light rays which function as the night illumination light. Each light-pervious tube 52 emits light around the 360 degree circumference thereof. Such 360 degree light emission of the light-pervious tube 52 functions as a night lamp FIG. 1 shows that the upper lid 10 and the seat 20 are all put down and closed to abut on a ceramic body of a closestool (not shown). When the light rays thrown forward by the light-pervious tube 52 of the night lamp 50 are shaded by the ceramic body of the closestool and the upper lid 10, the forward light rays of the light-pervious tube 52 can form an indicative light ring between the seat 20 and a top surface of the ceramic body to let the user know where the closestool and the toilet seat cover are. The light rays of the light-pervious tube 52 which goes backward are thrown on a front wall of a tank (not shown) on the ceramic body of the closestool and thrown on the top surface of the ceramic body to form a large-area reflected light for illuminating.

FIG. 2 shows that the upper lid 10 is opened and the seat 20 is not opened. The illumination range of the forward light rays of the light-pervious tube 52 of the night lamp 50 is defined by a space formed between the upper lid 10 and the seat 20. The backward light rays of the light-pervious tube 52 are thrown on a lower part of the front wall of the tank which is disposed on the ceramic body of the closestool and thrown on the top surface of the ceramic body, thereby forming the reflected light adapted to illuminate.

FIG. 3 shows that the upper lid 10 and the seat 20 are all opened or pulled up. The illumination range of the forward light rays of the light-pervious tube 52 of the night lamp 50 is defined by a space formed between the upper lid 10 and the seat 20. The backward light rays of the light-pervious tube 52 are thrown on the lower part of the front wall of the tank which is disposed on the ceramic body of the closestool and thrown on the top surface of the ceramic body, thereby forming the reflected light adapted to illuminate.

Therefore, the night lamp 50 mounted between the two seat shaft sleeves 21 of the seat 20 uses the light-pervious tube 52 to attain a full 360 degree light emission, and the using states of the upper lid 10 and the seat 20 do not affect the illumination and indication effect of the night lamp 50.

To detach the night lamp 50 for maintenance or for replacement of the batteries 53, the night lamp 50, as shown in FIG. 4, is pulled up to disconnect the locking units 55 at two ends of the lamp 50 from the locking holes 23 of the seat shaft sleeves 21. After the night lamp 50 is detached from the seat 20, the lid 511 of the electric body 51 is opened, and the batteries 53 are taken out and replaced. Thus, the replacement of the batteries 53 is quick and convenient. To maintain or replace the LED light source 541 or the circuit board 54, the light-pervious tube 52, as shown in FIG. 6, is extracted from the ends of the electric body 51 to replace the circuit board 54 and the LED light source 541. Thus, the maintenance and replacement of the light source end is quick and convenient. Particularly, the night lamp 50 can be quickly detached from the toilet seat cover to function as a portable night lamp for temporary illumination.

Because the night lamp 50 of this invention can be quickly detached from the toilet seat cover, the night lamp 50 can be independently taken out, and the power supply of the electric body 51 can be replaced. For example, it is allowed to mount lithium batteries 53 in the battery house 510 of the electric body 51, charge the lithium batteries and set a hidden plug. If the user wants to charge the lithium batteries, he should detach the night lamp 50 from the toilet seat cover, push or pull the plug out of the electric body 51, and then insert the plug into a household socket. Therefore, the operation of charging the night lamp 50 is very quick and convenient. After the batteries are fully charged, the night lamp 50 is mounted in the toilet seat cover again. Such structure can render the 220V power source unable to be directly introduced to the night lamp 50 disposed on the toilet seat cover of the closestool and can prevent an electric shock accident possibly caused by the 220V power source in contact with water.

Because the night lamp 50 of this invention can be quickly detached from the toilet seat cover, the night lamp 50 can be independently taken out, and the light-pervious and illuminating part of the night lamp 50 can be replaced. For example, a housing of the electric body 51 can be transparent and integrated with the light-pervious tube 52. Then, subsidiary elements, such as LED light source 541 with the circuit board 54, batteries 53 and relevant parts, can be put into the housing of the electric body 51 and the light-pervious tube 52. The two locking unit 55 are still disposed at two ends of the night lamp 50.

The Second Preferred Embodiment

Two Ends of the Night Lamp are Locked Between Two Lid Shaft Sleeves

Figure 9:
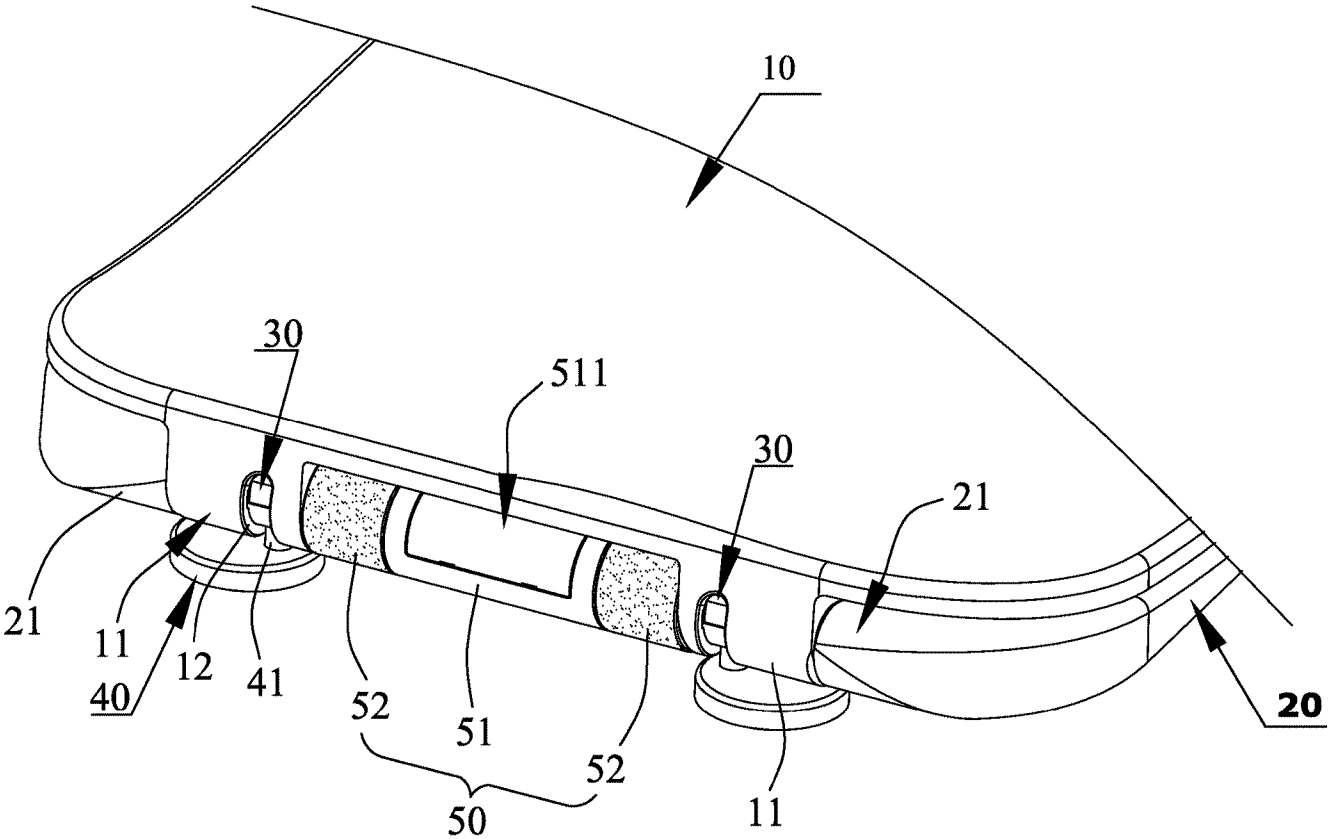
FIG. 9 is a perspective view showing a second preferred embodiment of this invention of which the night lamp is locked with the two lid shaft sleeves.

Referring to FIG. 9, the difference between this preferred embodiment and the first preferred embodiment is that this preferred embodiment has two seat shaft sleeves 21 at two sides of the rear of the seat 20 are respectively located at an outside of two lid shaft sleeves 11 at two sides of the rear of the upper lid 10. A long slot 12 is radially formed on each of the lid shaft sleeves 11. Each of the two supports 40 has a pin 41 which penetrates each long slot 21 formed on the lid shaft sleeve 11 to be capable of radially inserting in or extracting from each of the two hinges 30 for a connection fit. A cylindrical night lamp 50 is locked in a space defined between the two lid shaft sleeves 11 at the two sides of the rear of the upper lid 10. The night lamp 50 of this preferred embodiment has the same structure and operating principle as the first preferred embodiment. The locking mechanism in cooperation with two ends of the night lamp 50 and the two lid shaft sleeves 11 of the upper lid 10 and the locking principle are the same as those of the first preferred embodiment. Other structures and operating principle of this preferred embodiment are the same as those of the first preferred embodiment.

The Third Preferred Embodiment

Figure 10:
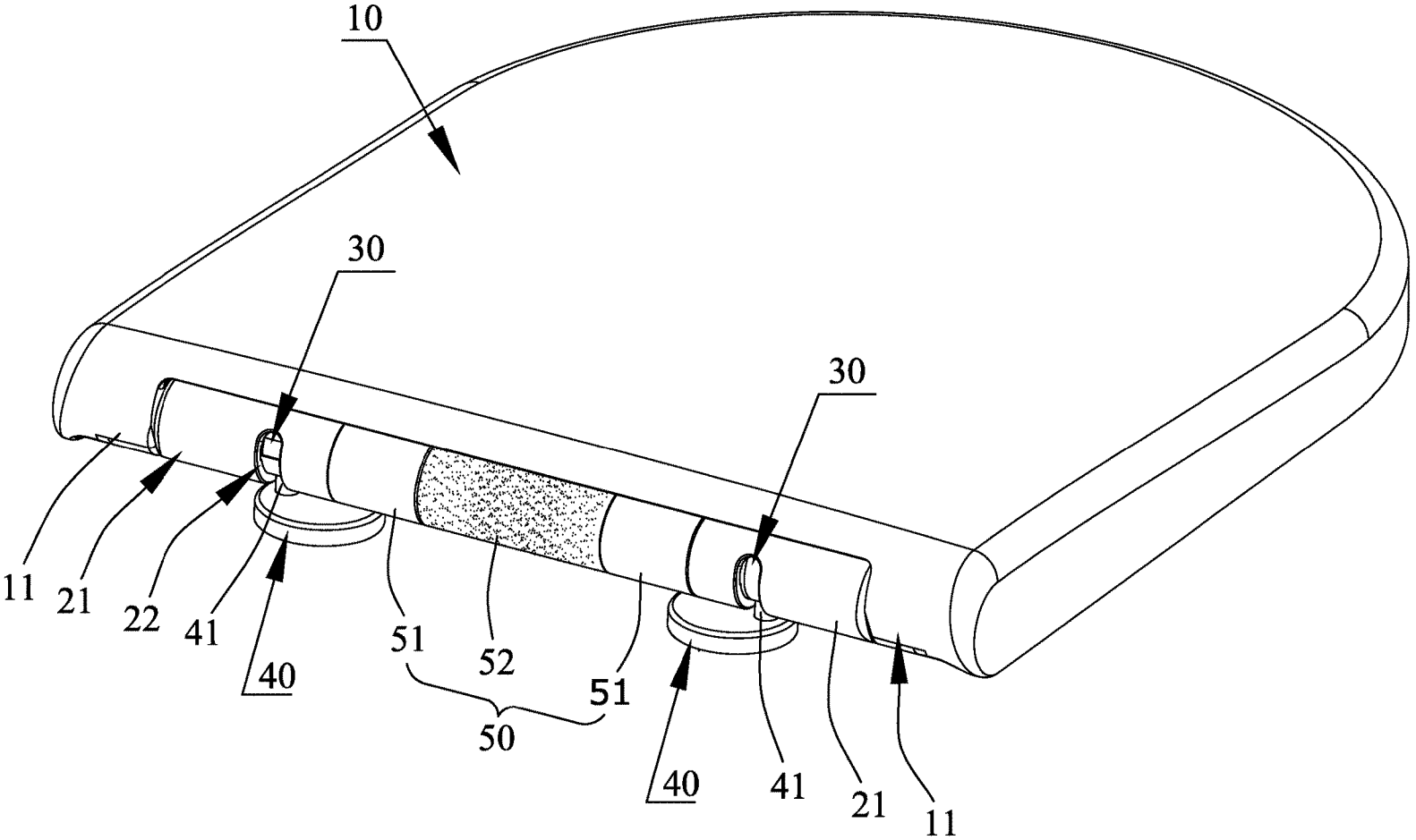
FIG. 10 is a perspective view showing a third preferred embodiment of this invention of which the night lamp comprises one light-pervious tube and two electric bodies connected to two ends of the light-pervious tube.
Figure 11:
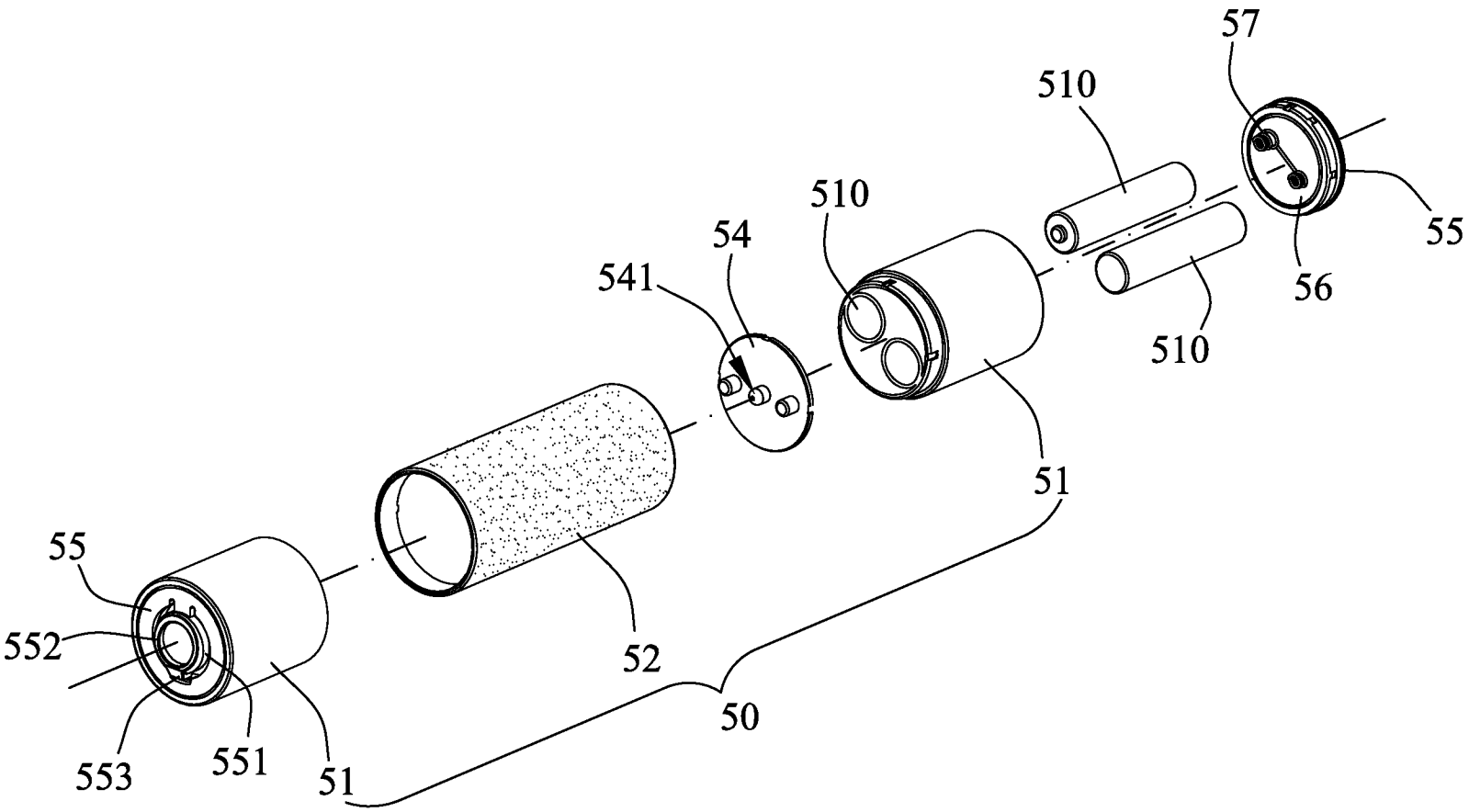
FIG. 11 is a cross-sectional view showing the whole night lamp of the third preferred embodiment of this invention.

The Night Lamp Includes One Light-Pervious Tube and Two Electric Bodies Disposed at Two Ends of the Light-Pervious Tube Referring to FIG. 10 and FIG. 11, the difference between this preferred embodiment and the first preferred embodiment is that the night lamp 50 of this preferred comprises two electric bodies 51 and one light-pervious tube 52. A battery house 510 is axially disposed on each of the electric bodies 51. At least one battery 53 or batteries 53 can be axially mounted in the battery house 510. One end of each electric body 51 is connected to a circuit board 54 which is electrically connected to the batteries 53. An LED light source 541 is disposed on the circuit board 54 for emitting light toward the light-pervious tube 52. The circuit board 54 and the LED light source 541 are constructed as a light source end of the electric body 51. Two ends of the light-pervious tube 52 are respectively connected to the light source ends of the two electric bodies 51. The other end of the each electric body 51 is sealed by a locking unit 55. The locking unit 55 blocks the battery house 510. A spring electrode 57 is disposed on a sealing cushion 56 which is disposed on a back surface of the locking unit 55 and connected in series with the batteries 53. The night lamp 50 of this preferred embodiment still adopts the locking units 55 fixed to the outside of each electric body 51 and elastically lodged in the locking holes 23 of the seat shaft sleeves 21. Other structures, operating principle and operations of this preferred embodiment are the same as those of the first preferred embodiment.

The structure of the electric body 51 of this preferred embodiment is more ingenious. The circuit board 54 with the LED light source 541 is fixed to one end of each electric body 51. Two batteries 53 are axially mounted in the circular battery house 510. The other end of the electric body 51 is sealed by the locking unit 55 so that the battery house 510 can be blocked by the locking unit 55. The spring electrode 57, disposed on the sealing cushion 56 of the back surface of the locking unit 55, and the batteries 53 are connected in series. The structure of the electric body 51 is small and ingenious, and the concatenation between two electric bodies 51, one light-pervious tube 52 and two locking units 55 is quick and convenient. Because the structure of the electric body 51 of this invention is made and the structure is small and fine, the night lamp 50 can be more exquisitely made by having each electric body 51 sleeved into the shorter light-pervious tube 52 and fixing the locking units 55 at the outside of the electric bodies 52 and the outside of the light-pervious tube 52. In other words, the 360 degree illumination and the location-indicating effect can be attained in a smaller space defined between the seat shaft sleeves 21 and the lid shaft sleeves 11.

While the embodiments of this invention are shown and described, it is understood that further variations and modifications may be made without departing from the scope of this invention.

We claim:

1. A toilet seat cover comprising an upper lid, a seat, two supports, and lid shaft sleeves formed on two opposed sides of a rear end of said upper lid that are hinged to seat shaft sleeves formed on two opposed sides of a rear end of said seat by using two hinges, each of said two supports having a pin, each pin being removably inserted into and detachably coupled with a respective one of said two hinges;

wherein one of said upper lid and said seat comprises a space defined between said sleeves thereof and a cylindrical night lamp is received and removably mounted in the space, the cylindrical night lamp having two ends, each end comprising a locking unit mounted thereto for removably coupling said cylindrical night lamp with said sleeves that define the space, said cylindrical night lamp including at least one electric body and at least one light-pervious tube, said at least one electric body having two ends, one of said two ends of said at least one electric body being defined as a first light source end, said first light source end of said at least one electric body being axially connected to said at least one light-pervious tube.

2. The toilet seat cover as claimed in claim 1, wherein the at least one electric body of cylindrical said night lamp includes one electric body and the at least one light-pervious tube of said cylindrical night lamp includes two light-pervious tubes, the other of said two ends of said at least one electric body being defined as a second light source end, one end of each of said two light-pervious tubes being fixed to each of said two ends of said electric body, a second end of each of said two light-pervious tubes being sealed by said locking units.

3. The toilet seat cover as claimed in claim 2, wherein a battery house is radially disposed in the middle of said electric body, at least one battery being radially mounted in said battery house, a lid being locked with an opening of said battery house, a circuit board being disposed at each of said two ends of said electric body and electrically connected to said battery, an LED light source being mounted on each of said circuit boards to emit light toward each of said two light-pervious tubes, said circuit boards and said LED light sources being constructed as said first and second light source ends.

4. The toilet seat cover as claimed in claim 1, wherein the at least one electric body of said cylindrical night lamp includes first and second electric bodies and the least one light-pervious tube includes one light-pervious tube, one of said two ends of the first electric body defined as said first light source end, one of said two ends of the second electric body being defined as a second light source end, said first light source end and said second light source end of said first and second electric bodies being respectively fixed to two opposite ends of said light-pervious tube, another end of each of said first and second electric bodies being sealed by said locking units.

5. The toilet seat cover as claimed in claim 4, wherein a battery house is axially disposed on each of said first and second electric bodies, at least one battery being axially mounted in each battery house, a circuit board being fixed to one of said two ends of each of said first and second electric bodies and electrically connected to said battery, an LED light source being mounted on each of said circuit boards to emit light toward said light-pervious tube, said circuit boards and said LED light sources being constructed as said first and second light source ends, the other end of said two ends of said first and second electric bodies being fixed to a respective locking unit, each locking unit blocking each battery house, a spring electrode being disposed on a back surface of each locking unit and connected in series with each battery.

6. The toilet seat cover as claimed in claim 1, wherein a locking hole is axially formed in each of said sleeves that define the space therebetween, an indentation being formed in an inner periphery of each locking hole, a spring being disposed on each of said locking units to correspond to each of said sleeves that define the space therebetween, a locking piece being formed on each spring so as to be received and positioned in each indentation.

7. The toilet seat cover as claimed in claim 6, wherein each spring comprises a locking ring projecting from a surface thereof, each locking ring in alignment with and receivable in one of said locking holes, each locking ring comprising a slope engageable, in a camming manner, with an end surface of a corresponding one of said sleeves that define the space therebetween for deformation of each spring and to guide each locking ring into each locking hole.

8. The toilet seat cover as claimed in claim 1, wherein a sealing cushion is sleeved into a back of each of said locking units.

9. The toilet seat cover as claimed in claim 1, wherein said lid shaft sleeves at two opposed sides of said rear end of said upper lid are located at an outside of said seat shaft sleeves at two opposed sides of said rear end of said seat, a slot being radially formed on each of said seat shaft sleeves, said pins being inserted into said hinges by penetrating said slot.

* * * * *